US010385481B2

(12) United States Patent
Underwood et al.

(10) Patent No.: US 10,385,481 B2
(45) Date of Patent: Aug. 20, 2019

(54) INNER LINING FABRIC WITH MOISTURE MANAGEMENT PROPERTIES

(71) Applicant: International Textile Group, Inc., Greensboro, NC (US)

(72) Inventors: Joey K. Underwood, Greenville, SC (US); Jacques A. Cantin, Greenville, SC (US)

(73) Assignee: International Textile Group, Inc., Greensboro, NC (US)

( * ) Notice: Subject to any disclaimer, the term of this patent is extended or adjusted under 35 U.S.C. 154(b) by 102 days.

(21) Appl. No.: 15/381,194

(22) Filed: Dec. 16, 2016

(65) Prior Publication Data

US 2017/0173370 A1 Jun. 22, 2017

Related U.S. Application Data

(60) Provisional application No. 62/269,454, filed on Dec. 18, 2015.

(51) Int. Cl.

| | |
|---|---|
| ***D03D 1/00*** | (2006.01) |
| ***D03D 15/12*** | (2006.01) |
| ***A41D 31/08*** | (2019.01) |
| ***A41D 31/12*** | (2019.01) |

(52) U.S. Cl.

CPC ..... *D03D 1/0035* (2013.01); *A41D 31/085* (2019.02); *A41D 31/125* (2019.02); *D03D 15/12* (2013.01); *D10B 2201/02* (2013.01); *D10B 2201/24* (2013.01); *D10B 2331/02* (2013.01); *D10B 2331/021* (2013.01)

(58) Field of Classification Search

CPC ..... A41D 2400/62; A41D 31/0027; D03D 15/12; D03D 1/0035; D10B 2201/02; D10B 2201/24; D10B 2331/02; D10B 2331/021

See application file for complete search history.

(56) References Cited

U.S. PATENT DOCUMENTS

| | | | |
|---|---|---|---|
| 3,019,821 | A | 11/1955 | White |
| 3,729,920 | A | 5/1973 | Sayers et al. |
| 4,304,811 | A | 12/1981 | David et al. |
| 4,749,378 | A | 6/1988 | Cates et al. |

(Continued)

FOREIGN PATENT DOCUMENTS

| | | |
|---|---|---|
| GB | 2275934 | 9/1994 |
| GB | 2516134 | 1/2015 |
| WO | WO 2011/050376 A1 | 5/2011 |

OTHER PUBLICATIONS https://www.behance.net/gallery/17788705/FABRICS-DESIGN-(DEVELOPED-ON-DOBBY-LOOM—see p. 20) no date.*
Abstract of JP 2009280942 dated Dec. 3, 2009, 2 pages.

*Primary Examiner* — Arti Singh-Pandey
(74) *Attorney, Agent, or Firm* — Dority & Manning, P.A.

(57) ABSTRACT

A fabric having moisture management properties is disclosed. The fabric can also be made to be fire resistant. The fabric is particularly well suited for being used as an inner lining in protective garments. The fabric contains first yarns and second yarns. The first yarns extend in a first direction and the second yarns extend in the second direction. The yarns are woven together such that the first yarns form a pattern of shapes. The pattern of shapes concentrate the FR cellulose fibers and provide channels for carrying away moisture and improving the moisture management properties of the fabric.

20 Claims, 4 Drawing Sheets

(56) References Cited

U.S. PATENT DOCUMENTS

| | | | |
|---|---|---|---|
| 4,759,770 | A | 7/1988 | Cates et al. |
| 5,299,602 | A | 4/1994 | Barbeau et al. |
| 5,858,888 | A | 1/1999 | Underwood et al. |
| 5,928,971 | A | 7/1999 | Ellis et al. |
| 6,065,153 | A | 5/2000 | Underwood et al. |
| 6,132,476 | A | 10/2000 | Lunsford et al. |
| 6,192,520 | B1 | 2/2001 | Underwood et al. |
| 6,247,179 | B1 | 6/2001 | Underwood et al. |
| 6,460,321 | B1 | 10/2002 | Koshimae et al. |
| 6,547,835 | B1 | 4/2003 | Lunsford et al. |
| 6,606,749 | B2 | 8/2003 | Underwood et al. |
| 6,624,096 | B2 | 9/2003 | Thomas et al. |
| 6,750,162 | B2 | 6/2004 | Underwood et al. |
| 6,818,024 | B2 | 11/2004 | Lunsford et al. |
| 6,867,154 | B1 | 3/2005 | Lunsford et al. |
| 6,886,184 | B2 | 5/2005 | Underwood et al. |
| 6,974,785 | B1 | 12/2005 | Barbeau et al. |
| 7,393,800 | B2 | 7/2008 | Corner |
| 7,581,260 | B2 | 9/2009 | Underwood et al. |
| 7,589,036 | B2 | 9/2009 | Corner et al. |
| 7,811,952 | B2 | 10/2010 | Truesdale, III et al. |
| 7,862,865 | B2 | 1/2011 | Truesdale, III et al. |
| 8,071,492 | B2 | 12/2011 | Hess et al. |
| 8,209,785 | B2 | 7/2012 | Underwood et al. |
| 8,528,120 | B2 | 9/2013 | Underwood et al. |
| 8,614,156 | B2 | 12/2013 | Hess et al. |
| 8,793,814 | B1 * | 8/2014 | Dilanni ..... D02G 3/047 2/272 |
| 8,819,866 | B2 | 9/2014 | Underwood et al. |
| 8,932,863 | B2 * | 1/2015 | Wang ..... G01N 33/2835 250/282 |
| 9,364,694 | B2 | 6/2016 | Underwood et al. |
| 2002/0026663 | A1 | 3/2002 | Underwood et al. |
| 2003/0040240 | A1 | 2/2003 | Thomas |
| 2003/0203690 | A1 | 10/2003 | Hess et al. |
| 2003/0228812 | A1 | 12/2003 | Stanhope et al. |
| 2004/0034905 | A1 | 2/2004 | Underwood et al. |
| 2004/0092187 | A1 | 5/2004 | Favier et al. |
| 2004/0152378 | A1 | 8/2004 | Stanhope et al. |
| 2005/0155131 | A1 | 7/2005 | Underwood et al. |
| 2005/0158559 | A1 | 7/2005 | Martin et al. |
| 2005/0186875 | A1 | 8/2005 | Lilani |
| 2006/0154542 | A1 | 7/2006 | Underwood et al. |
| 2007/0072502 | A1 | 3/2007 | Underwood et al. |
| 2011/0049949 | A1 | 3/2011 | Basmaji et al. |
| 2011/0165807 | A1 | 7/2011 | Underwood et al. |
| 2011/0191949 | A1 | 8/2011 | Underwood et al. |
| 2011/0281097 | A1 | 11/2011 | Li et al. |
| 2012/0270456 | A1 | 10/2012 | Gstettner et al. |
| 2013/0008554 | A1 | 1/2013 | Fisher et al. |
| 2014/0113122 | A1 * | 4/2014 | Smith ..... D03D 15/12 428/219 |
| 2014/0208491 | A1 * | 7/2014 | Schmitt ..... A41D 31/0022 2/458 |
| 2017/0175302 | A1 * | 6/2017 | Habicht ..... D02G 3/04 |

* cited by examiner

INNER LINING FABRIC WITH MOISTURE MANAGEMENT PROPERTIES

RELATED APPLICATIONS

The present application is based upon and claims priority to U.S. Provisional Patent application having Ser. No. 62/269,454 filed on Dec. 18, 2015, and herein incorporated by reference.

BACKGROUND

Various different types of protective garments exist that are designed to protect the wearer in the environment in which the garment is worn. For instance, various protective garments exist that are intended to be fire resistant. Such garments are worn by military personnel, industrial workers, pilots, rescue personnel, and firefighters.

Firefighter garments, for instance, are intended to not only protect the firefighter from exposure to fires but are also designed to be water resistant. Firefighter garments typically include multiple layers of materials. For example, firefighter garments typically include an outer shell attached to an inner lining or face cloth. The firefighter garment may include intermediate layers, such as a moisture barrier layer and/or a thermal barrier layer. Each layer can be made from fire resistant materials, such as fire resistant fibers and yarns.

Many protective garments, such as firefighter garments, are intended not only to protect the wearer from fire and other elements, but the garments should also be comfortable to wear. For example, firefighter garments that do not provide water resistance may absorb water during use and increase in weight thereby increasing the load on the wearer.

The inner lining of protective garments as described above should also display high lubricity characteristics. A low friction inner lining, for instance, makes it much easier to don the garment and to take the garment off later. A low friction inner lining also can substantially increase the comfort of the garment during use, especially when the wearer is actively moving. Ultimately, a low friction inner lining can reduce the amount of stress imposed on the wearer, especially when worn in harsh environments.

In this regard, those skilled in the art in the past have attempted to produce inner linings for protective garments that are not only fire resistant but also have excellent lubricity characteristics. For example, inner linings made from multi-filament yarns and spun yarns are disclosed in U.S. Pat. Nos. 6,247,179, 5,858,888, and U.S. Patent Application Publication No. 2013/0205481 which are incorporated herein by reference. The inner linings disclosed in the above patents have provided great advancements in the art demonstrated by significant commercial success. U.S. Pat. No. 5,539,928 and U.S. Patent Publication No. 2009/0255038, which are also both incorporated herein by reference, also disclose inner liners having high lubricity characteristics.

Although the above constructions have made great advances in the art, the present disclosure is directed to further improvements not only to inner lining fabrics, but also to fabrics used in any application where moisture management issues exist. In particular, the present disclosure is directed to further improvements in fabrics for removing or wicking away moisture from the wearer.

SUMMARY

In general, the present disclosure is directed to a fabric having excellent moisture management properties. In one embodiment, the fabric may be used as an inner lining fabric for a protective garment. In one embodiment, for instance, the protective garment can include an outer shell having an exterior surface and an inside surface. An inner lining made according to the present disclosure can be positioned on the inside surface of the outer shell. The inner lining can be directly affixed to the outer shell or may be attached to a garment subassembly that is then connected to the outer shell.

In one embodiment, the fabric of the present disclosure includes first yarns in a first direction and second yarns in a second direction. For instance, the first yarns may comprise the warp yarns while the second yarns may comprise the fill yarns. Alternatively, the first yarns may comprise the fill yarns and the second yarns may comprise the warp yarns. The first yarns contain fire resistant (FR) cellulose fibers in an amount of at least 20% by weight, such as at least about 30% by weight. The second yarns can contain inherently flame resistant fibers. The inherently flame resistant fibers, for instance, may comprise aramid fibers, PBI fibers, PBO fibers, or mixtures thereof. In one embodiment, the second yarns contain at least 70% by weight inherently flame resistant fibers. The first yarns comprise spun yarns, while the second yarns comprise spun yarns or filament yarns. When the second yarns comprise filament yarns, the inherently flame resistant fibers may comprise filaments.

In accordance with the present disclosure, in one embodiment, the first yarns are woven with the second yarns such that the first yarns form a pattern of shapes and wherein each shape contains a greater concentration of FR cellulose fibers than contained in the remainder of the fabric or in the background pattern. For instance, the concentration of FR cellulose fibers in the shapes can be greater than about 30% by weight, such as greater than about 40% by weight, such as greater than about 50% by weight, such as greater than about 60% by weight, and up to 100% by weight. In one embodiment, the pattern of shapes may comprise a pattern of discrete shapes. For example, in one particular embodiment, the shapes may be in the form of water droplets. The shapes may occupy greater than about 20% of the surface area of the fabric, such as greater than about 30% of the surface area of the fabric, such as greater than about 40% of the surface area of the fabric, such as greater than about 50% of the surface area of the fabric, and generally less than about 80% of the surface area, such as less than about 70% of the surface area. Each shape can have a greatest length dimension of from about 1 mm to about 10 mm and can have a greatest width dimension of from about 1 mm to about 10 mm.

In one embodiment, the moisture management properties of the fabric are improved by forming the pattern of shapes within the fabric. In an alternative embodiment, however, good moisture management properties may be obtained without having to form the shapes in the fabric and can reside in the selection of the fiber furnish used to form the fabric.

In one embodiment, the first yarns containing the FR cellulose fibers comprise spun yarns, such as ring spun yarns, made from an intimate blend of fibers. In one particular embodiment, the blend of fibers may comprise meta-aramid fibers in an amount from about 30% to about 60% by weight of the fabric, flame resistant fibers in an amount from about 20% to about 50% by weight of the fabric, non-aromatic polyamide fibers in an amount from about 12% to about 25% by weight of the fabric, and optionally para-aramid fibers in an amount up to about 15% by weight of the fabric.

In one embodiment, the entire fabric contains from about 40% to about 80% by weight aramid fibers, from about 10% to about 50% by weight FR cellulose fibers, and from about 3% to about 18% non-aromatic polyamide fibers.

Inner linings made according to the present disclosure can have excellent flame resistant properties, even after being laundered. For instance, the inner lining may display a char length of less than about 40 mm, such as less than about 30 mm, such as even less than about 20 mm in at least one direction when tested according to ASTM Test D6413 and after being subjected to five laundry cycles.

In one embodiment, the inner lining can further be treated with an odor control agent. The odor control agent may comprise, for instance, a silver ion. In one embodiment, for instance, the odor control agent may comprise a silver zeolite.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
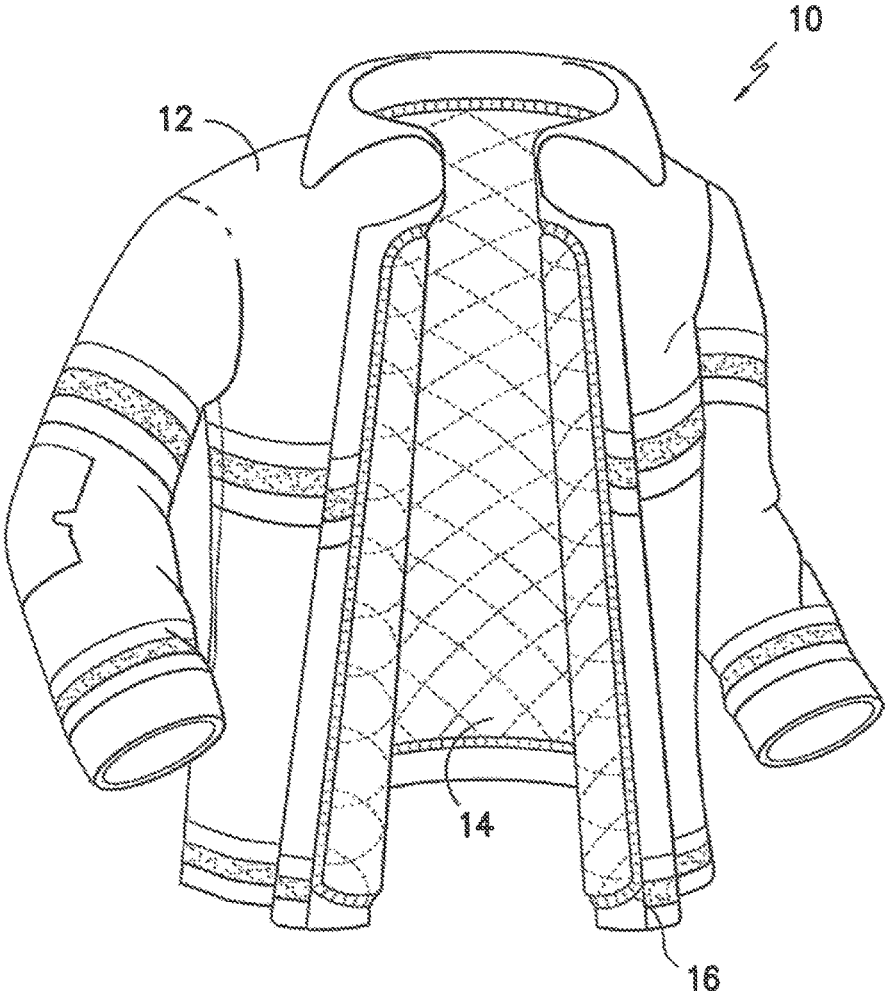
FIG. 1 is a perspective view of one embodiment of a protective garment made in accordance with the present disclosure.
Figure 2:
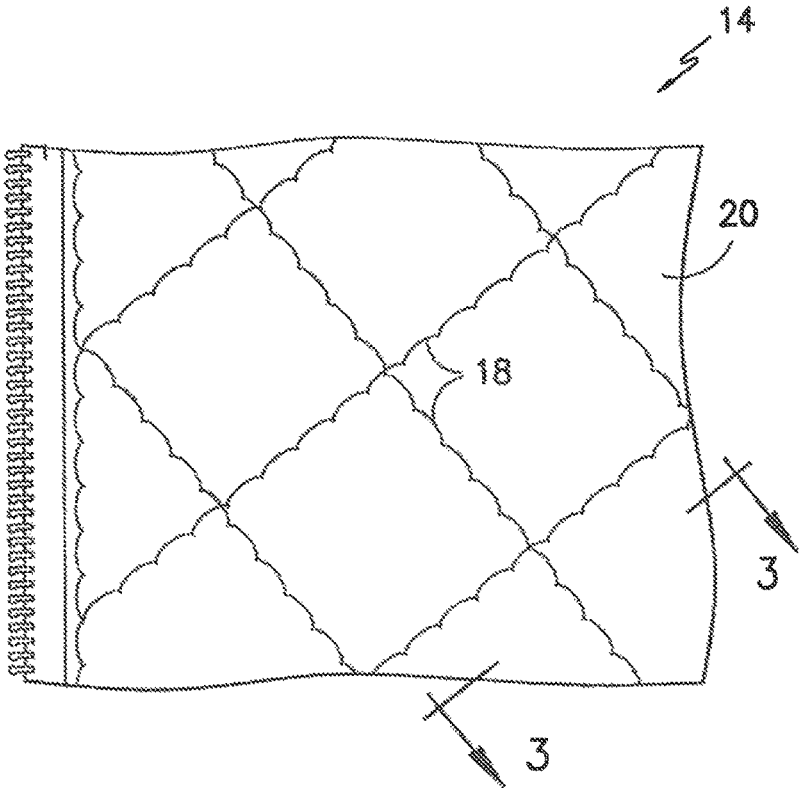
FIG. 2 is a plan view of one embodiment of an inner lining made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to a fabric for protective garments that may form an inner liner. In one embodiment, the protective garment is flame resistant and thus protects the wearer from exposure to fire, including flash fires. The inner liner can be constructed to not only be flame resistant but can also have moisture management properties.

Although the fabric of the present disclosure is well suited for being used as an inner liner in protective garments, it should also be understood that the fabric can be used in numerous other applications. For instance, the fabric can be used in any application where moisture management properties are important. For instance, the fabric can also be used to construct any type of article of clothing, such as shirts, pants, gloves, and the like. In one embodiment, the fabric can be used to produce military uniforms, such as battle dress uniforms. The fabric can also be used to produce jackets, coats, hunting apparel, and the like.

In general, the fabric of the present disclosure is made from a woven or knitted fabric that includes at least a first yarn and a second yarn. The first yarn, for instance, can extend in a first direction and the second yarn can extend in a second direction. The second direction can be opposite to the first direction. In one embodiment, for instance, the first yarns may comprise the warp yarns while the second yarns may comprise the fill yarns. Alternatively, the first yarns may comprise the fill yarns and the second yarns may comprise the warp yarns. It should be understood that the fabric of the present disclosure can include further yarns extending in the warp and/or fill direction and do not have to be exclusively made from the first and second yarns. In one embodiment, however, the fabric is made only from the first and second yarns.

In accordance with the present disclosure, the first yarn contains substantial amounts of FR cellulose fibers. For instance, the first yarns can contain FR cellulose fibers in an amount of at least 20% by weight, such as in an amount of at least 25% by weight, such as in an amount of at least 30% by weight, such as in an amount of at least 35% by weight, such as in an amount of at least 40% by weight, such as in an amount of at least 45% by weight, such as in an amount of at least 50% by weight, such as in an amount of at least 60% by weight, such as in an amount of at least 70% by weight, and even up to 100% by weight. When the yarns are made from a blend of fibers, the first yarns contain FR cellulose fibers in an amount less than about 70% by weight, such as in an amount less than about 60% by weight, such as in an amount less than about 50% by weight, such as in an amount less than about 40% by weight. The second yarns, on the other hand, are generally made from a different fiber furnish from the first yarns. The second yarns may also have a different texture, shade, hue and/or color from the first yarns. In one embodiment, the second yarns contain inherently flame resistant fibers. The second yarns may comprise spun yarns, stretch broken yarns, filament yarns, and the like.

In accordance with the present disclosure, the first yarns are woven or knitted with the second yarns such that the first yarns form a pattern of shapes within the fabric. The shapes can be visible from a surface of the fabric. Each shape contains a greater concentration of FR cellulose fibers than the background of the fabric. For example, each shape can contain FR cellulose fibers in an amount greater than about 25% by weight, such as in an amount greater than about 30% by weight, such as in an amount greater than about 35% by weight.

In one embodiment, the first yarns contain FR cellulose fibers in combination with other fibers. The other fibers may comprise inherently flame resistant fibers, non-aromatic polyamide fibers, polyester fibers, and the like. In one embodiment, the first yarns contain FR cellulose fibers in combination with meta-aramid fibers, non-aromatic polyamide fibers, and optionally para-aramid fibers.

The FR cellulose fibers contained in the fabric allow for better breathability and better moisture management properties. As described above, in one embodiment, the fabric is constructed such that the first yarns form a pattern of shapes within the fabric. Within these shapes, the FR cellulose fibers are concentrated. These shapes, therefore, form channels to wick away moisture, especially when the fabric is incorporated into a garment and faces the wearer. Thus, the fabric of the present disclosure is particularly well suited for use as a liner fabric.

FIG. 1 illustrates an improved protective garment 10 constructed in accordance with the present disclosure. Garment 10 includes a relatively tough outer shell 12 having a liner assembly 14 located therein. Outer shell 12 and liner assembly 14 together function to protect a wearer from heat and flame such as may be encountered during firefighting activities.

Liner assembly 14 may be constructed as a separate unit that may be removed from outer shell 12. A zipper 16 is provided in this case to maintain liner assembly 14 in position within outer shell 12 as shown. It should be appreciated, however, that other suitable means of attachment, such as various hook and pile arrangements, may also be utilized for this purpose.

In an alternative embodiment, the liner can be permanently attached to the garment.

Figure 3:
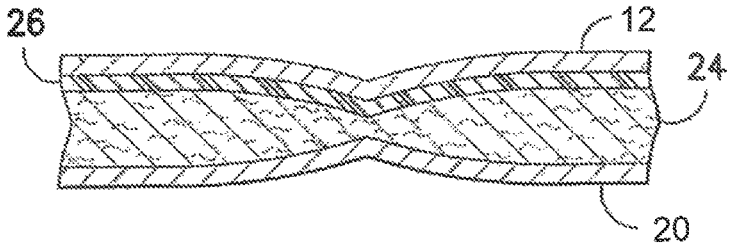
FIG. 3 is a cross-sectional view taken along lines 3-3 of FIG. 2.

Referring to FIG. 3, one embodiment of a multi-layered garment in accordance with the present disclosure is shown. As shown, the garment includes a plurality of material layers quilted together by crisscrossing stitch lines 18. The stitch lines may hold together a thermal barrier layer 24 a moisture barrier layer 26, and a lining layer 20.

Typically, lining layer 20 will be adjacent the wearer's body during use. As will be described more fully below, lining layer 20 is made from a textile material having good moisture management properties.

In the illustrated embodiment, an aramid felt, such as a felt produced from meta-aramid fibers, is utilized to provide thermal barrier layer 24. The felt functions as an insulator to inhibit transfer of heat from the ambient environment to the wearer.

Moisture barrier layer 26 is preferably a suitable polymeric membrane that is impermeable to liquid water but is permeable to water vapor. As such, exterior water (such as from a firefighter's water hose) will not penetrate the interior of garment 10, but perspiration from the firefighter can escape. Suitable membranes of this type are distributed by W. L. Gore & Associates under the trademark Gore-Tex.

Figure 5:
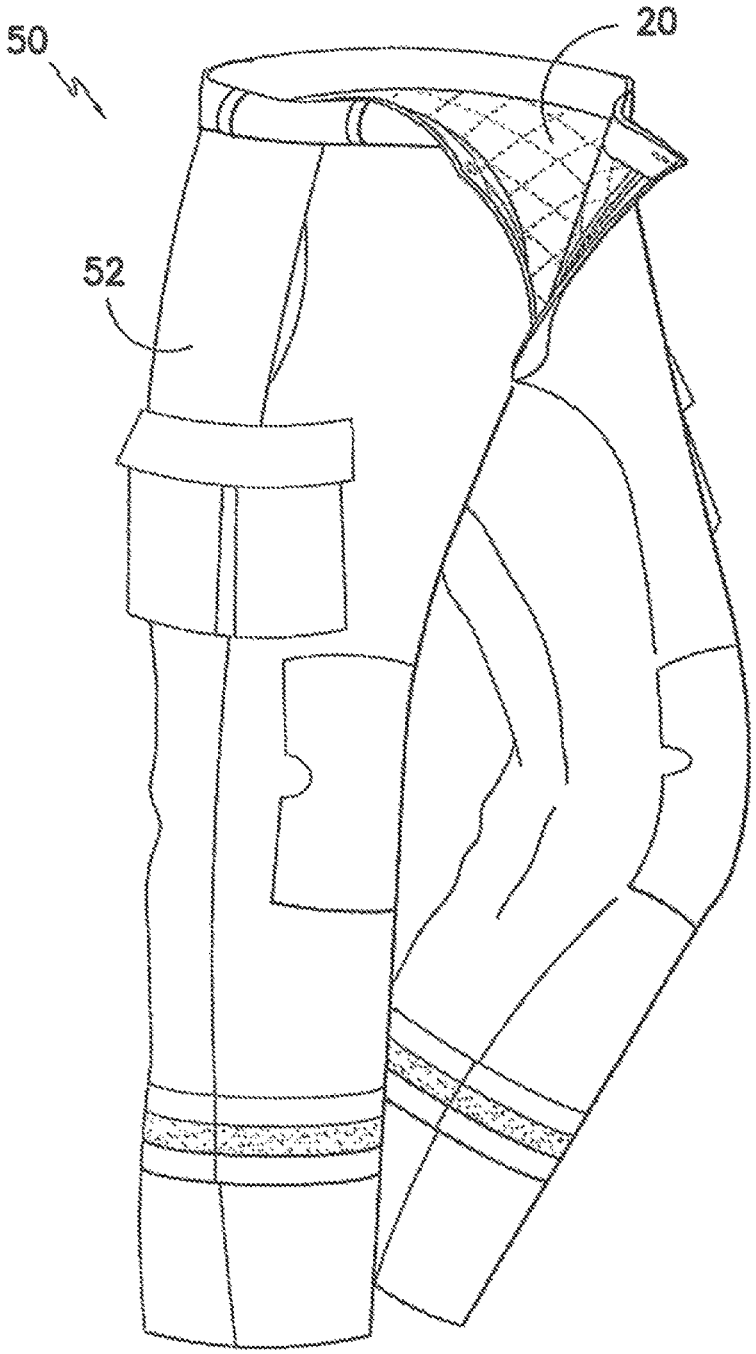
FIG. 5 is a perspective view with cutaway portions of one embodiment of trousers made in accordance with the present disclosure.

In addition to being used in coats and jackets as shown in FIG. 1, the lining layer of the present disclosure may also be used to line other garments. For instance, referring to FIG. 5, a pair of trousers made in accordance with the present disclosure is illustrated. As shown, the trousers 50 include an outer shell 52 similar to the outer shell 12 shown in FIG. 1. In addition, the trousers 50 include a lining layer 20 positioned to be adjacent the wearer's body during use.

Figure 4:
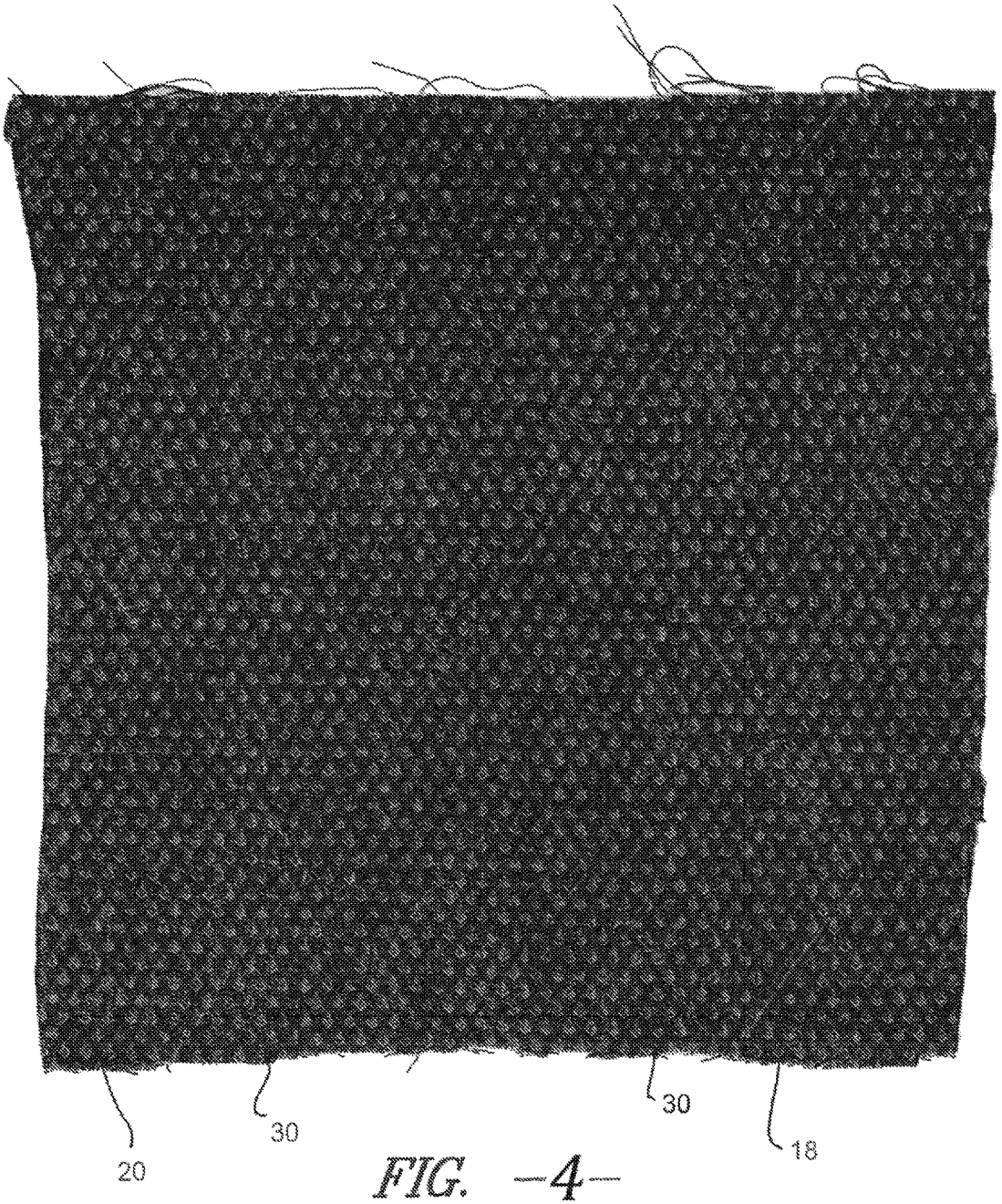
FIG. 4 is a plan view of one embodiment of an inner lining made in accordance with the present disclosure.

FIG. 4 illustrates a textile material or fabric 20 that may be used to construct the lining layer. In the embodiment illustrated in FIG. 4, crisscrossing stitch lines 18 are included to show the quilting effect.

As shown, fabric 20 includes a pattern of shapes 30, and particularly a pattern of discrete shapes. In an alternative embodiment, however, the shapes 30 may be interconnected. The yarns of the fabric are woven together such that the yarn containing greater amounts of FR cellulose fibers are contained within the discrete shapes 30. In this manner, the FR cellulose fibers become concentrated where the shapes are located and provide channels to carry away moisture. The second yarns contained in the fabric may contain little to no FR cellulose fibers. In this manner, the fabric provides an excellent combination of protection, comfort, moisture management, strength and durability.

In general, the yarns can be woven to produce any suitable pattern that can include shapes 30 having any particular size. In the embodiment illustrated in FIG. 4, the shapes 30 have a water droplet or raindrop appearance. Each shape 30 has a maximum width of about 3 mm and a maximum length of about 5 mm. These dimensions can vary depending upon the particular application.

In alternate embodiments, for instance, the shapes 30 may comprise triangles, squares, polygons, circles, ovals, or any other shape as may be desired. When in the form of discrete shapes, the shapes can have a maximum width dimension and/or a maximum length dimension of greater than about 1 mm, such as greater than about 2 mm, such as greater than about 3 mm, such as greater than about 4 mm, such as greater than about 5 mm, such as greater than about 6 mm, such as greater than about 10 mm, such as even greater than about 15 mm. The length and width of the shapes is generally less than about 20 mm, such as less than about 15 mm, such as less than about 10 mm, such as less than about 7 mm, such as less than about 6 mm, such as less than about 5 mm. The length and the width can be the same or different within the above dimensions. In other embodiments, however, instead of discrete shapes, the shapes 30 may comprise stripes, columns, rows, grids, or the like.

In order to produce the fabric 20, any suitable weaving or knitting device may be used. In one embodiment, for instance, the fabric may be made using a dobby or jacquard weaving system. For instance, in one embodiment, the fabric 20 may include a dobby weave.

As described above, the fabric is made from first yarns and second yarns. The first and second yarns can extend in different directions depending upon how the fabric is made. The first yarns contain FR cellulose fibers, such as FR viscose fibers that provide excellent moisture management, improved comfort and softness.

As used herein, flame resistant cellulose fibers refers to cellulose fibers that have been treated with a flame resistant composition or flame retardant. The inclusion of cellulose fibers in the fiber blend can make the resulting fabric softer, more breathable, and less expensive. Examples of flame resistant cellulose fibers that may be incorporated into the fabric include FR cotton, FR rayon, FR acetate, FR triacetate, FR lyocell, and mixtures thereof. In one particular embodiment, FR rayon fibers are incorporated into the fiber blend. FR rayon fibers are available from various different sources. FR rayon fibers, for instance, are sold under the name LENZING by Lenzing Fibers of Austria. LENZING FR fibers are viscous fibers that have been treated with a flame retardant composition. In one embodiment, the flame resistant rayon fibers are made by spinning reconstituted cellulose from beech trees. Such fibers are more water absorbent than cotton fibers.

As described above, flame resistant cellulose fibers comprise fibers that have been treated with a flame retardant composition. The flame retardant composition can be incorporated into the fibers using various methods and techniques. For instance, the flame retardant composition can be incorporated into the fibers during spinning, can be coated on the fibers, or can be absorbed into the fibers. The flame retardant composition may contain, for instance, a phosphorus compound, a halogen compound, or any other suitable flame resistant agents.

In one embodiment, the FR cellulose fibers contained in the first yarn can be combined with inherently flame resistant fibers and/or non-inherently flame resistant fibers. For instance, the FR cellulose fibers can be combined with aramid fibers, polybenzimidazole (PBI) fibers, poly-p-phenylenebenzobisoxazole (PBO) fibers, non-aromatic polyamide fibers, polyester fibers, and mixtures thereof.

In one embodiment, the first yarns comprise spun yarns. The spun yarns can comprise ring spun yarns. Ring spun yarns, as opposed to airjet yarns, can be more comfortable, stronger and have a better feel. Alternatively, the first yarns may comprise filament yarns, such as multifilament yarns. In this embodiment, the FR cellulose fibers comprise filaments that may optionally be combined with other filaments such as filaments made from any of the materials described above.

In one embodiment, the first yarns contain the FR cellulose fibers combined with meta-aramid fibers, non-aromatic polyamide fibers, and optionally para-aramid fibers. The meta-aramid fibers provide excellent thermal protection and durability. The para-aramid fibers provide excellent shrinkage control, break open protection and enhanced fabric strength. The polyamide fibers (nylon) provide improved strength and fabric durability.

In one embodiment, most of the inherently flame resistant fibers present in the fiber blend comprise meta-aramid fibers, which are also known as fibers comprised of poly (metaphenylene isophthalamide). Meta-aramid fibers are available from numerous commercial sources. For instance, in one embodiment, the meta-aramid fibers may comprise NOMEX® fibers sold by E.I. duPont de Nemours and Company. The meta-aramid fibers are present in the fiber blend in an amount of at least about 30% by weight, such as from about 30% by weight to about 60% by weight. In one embodiment, for instance, the meta-aramid fibers are present in the fiber blend in an amount from about 40% to about 50% by weight. When present in the above amounts, the meta-aramid fibers provide the resulting fabric with significant flame resistant properties.

The meta-aramid fibers contained in the fabric can be substantially amorphous, crystalline, or a mixture of both. Amorphous meta-aramid fibers, for instance, generally have a crystallinity of less than about 10%. Crystalline fibers, on the other hand, generally have a crystallinity of greater than 10%, such as greater than 25%, such as having a crystallinity of from about 25% to about 40%.

Optionally, other inherently flame resistant fibers may be present in the blend, such as para-aramid fibers. When present, the para-aramid fibers are added in amounts much less than the meta-aramid fibers. For instance, the para-aramid fibers may be present in an amount less than about 15% by weight, such as from about 3% to about 15% by weight. The para-aramid fibers can be present in an amount sufficient to reduce shrinkage of the fabric and to provide greater strength to the fabric. The amount of para-aramid fibers, however, can be minimized in order to maintain a lower cost. Para-aramid fibers are available from numerous commercial sources. In one embodiment, for instance, the para-aramid fibers may comprise fibers sold under the trade name KEVLAR® available from E.I. duPont de Nemours and Company.

In addition to the above fibers, the fiber blend can further contain fibers that increase the durability of the fabric. For instance, in one embodiment, non-aromatic polyamide fibers may be incorporated into the fiber blend, such as nylon fibers. The amount of non-aromatic polyamide fibers incorporated into the fiber blend can be carefully controlled so as to maintain the desirable flame resistant properties of the fabric while increasing the durability of the fabric. In this regard, the non-aromatic polyamide fibers may be present in the fiber blend in an amount from about 12% to about 25% by weight, and particularly from about 15% to about 20% by weight.

Of particular importance, in one embodiment, the non-aromatic polyamide fibers are substantially pure and contain no other fillers or other ingredients. Using substantially pure non-aromatic polyamide fibers, for instance, has been found to improve the abrasion resistance of the fabric if controlled within the above described amounts. When added in the above described amounts, the non-aromatic polyamide fibers also do not substantially compromise the flame resistant properties of the overall fabric.

The second yarns that are combined with the first yarns can generally contain any suitable fibers. The second yarns can comprise spun yarns, stretch broken yarns, or filament yarns, such as multifilament yarns. The second yarns can be made from fire resistant fibers or can be made from other fibers.

In one embodiment, the second yarns are made primarily from inherently flame resistant fibers. For instance, the second yarns can be made from greater than 50%, such as greater than 60%, such as greater than 70%, such as greater than 80% by weight aramid fibers alone or in combination with PBI fibers and/or PBO fibers. The aramid fibers may comprise meta-aramid fibers alone, para-aramid fibers alone, or a combination of meta-aramid fibers and para-aramid fibers. In one particular embodiment, the second yarns comprise spun yarns containing meta-aramid fibers and optionally in combination with up to about 8% by weight of para-aramid fibers.

Alternatively, the second yarns may comprise substantial amounts of other synthetic fibers, such as nylon fibers and/or polyester fibers. For instance, the second yarns may contain greater than 30% by weight, such as greater than 40% by weight, such as greater than 50% by weight, nylon fibers, polyester fibers, or mixtures thereof. In one embodiment, the second yarns can be made exclusively from polyester fibers and/or nylon fibers.

As described above, in one embodiment, the second yarns may comprise filament yarns such as multifilament yarns. The multifilament yarns may contain aramid fibers, poly-p-phenylenebenzobisoxazole fibers (PBO fibers), synthetic fibers such as polyamide fibers, and mixtures thereof. In one embodiment, the filament yarns are made exclusively from inherently flame resistant fibers. For instance, the filament yarns may be made exclusively from para-aramid fibers or meta-aramid fibers.

The weight of the filament yarns can vary depending upon the particular application, the desired weight of the fabric, and various other factors. In general, the filament yarns can have a weight of greater than about 100 denier, such as greater than about 140 denier, such as greater than about 180 denier. The denier of the filament yarns is generally less than about 500 denier, such as less than about 400 denier. In one embodiment, the filament yarns have a denier of from about 150 to about 250, such as from about 180 to about 220.

When the second yarns are spun yarns, similar to the filament yarns, the weight of the spun yarns can also vary depending upon the particular application. The spun yarns, for instance, can have a weight of from about 20/1 to about 50/1.

In one particular embodiment, the fabric of the present disclosure contains first yarns made from a fiber blend and second yarns made from primarily meta-aramid fibers. In one embodiment, for instance, the entire fabric contains aramid fibers in an amount from about 40% to about 80% by weight, such as in an amount from about 60% to about 70% by weight. The amount of FR cellulose fibers contained in the fabric can be from about 10% to about 50% by weight, such as from about 15% to about 40% by weight. Nylon can be present in the fabric in an amount from about 3% to about 18% by weight, such as in an amount from about 10% to about 15% by weight. The aramid fibers present can comprise meta-aramid fibers, para-aramid fibers, or a combination of both. In one particular embodiment, meta-aramid fibers are present in the fabric in an amount from about 55% to about 75% by weight, while para-aramid fibers are present in the fabric from about 2% to about 8% by weight.

The fabric of the present disclosure can contain only the first yarns and the second yarns or may contain various other yarns. Various other yarns, for instance, can be inserted within the first yarns, within the second yarns, or within both. The yarns can be woven or knitted together such that the first yarns form any suitable pattern. The pattern can occupy any desired amount of surface area on the face of the fabric. In general, any pattern capable of concentrating the amount of FR cellulose fibers in a certain area may be used.

The basis weight of the fabric can vary depending upon the particular application. In one embodiment, for instance, the fabric is relatively lightweight. For instance, the fabric can have a basis weight of less than about 5 osy, such as less than about 4.5 osy, such as less than about 4 osy, such as less than about 3.5 osy, such as less than about 3 osy, such as less than about 2.5 osy, such as less than about 2 osy, such as less than about 1.5 osy. The fabric generally has a basis weight of greater than about 1 osy, such as greater than about 2 osy. In other embodiments, however, heavier fabrics can be made that have a basis weight of from about 4.5 osy to about 9 osy, such as from about 5 osy to about 8 osy.

In general, the fabric of the present disclosure may be treated with various finishes. In one particular embodiment, for instance, the fabric may be treated with an anti-odor agent. For instance, the anti-odor agent may comprise metal ions, such as silver ions. The silver ions may act as an antimicrobial agent for reducing odors. In one embodiment, the silver ions may be present in a compound or complex that also absorbs odors. For instance, in one embodiment, the silver ions may be present in a porous zeolite.

In one embodiment, the fabric of the present disclosure may be powder coated with an anti-odor agent. For instance, the anti-odor agent may be in the form of particles having a size of less than about 1 micron, such as from about 0.001 microns to about 1 micron. The anti-odor agent may be combined with a pre-polymer or polymer. The resulting particles may then be heated and applied to the fabric. The polymer or pre-polymer forms an attachment to the surface. The polymer or pre-polymer may comprise a thermoplastic polymer or a thermosetting polymer. The polymer may comprise, for instance, polyester resins, epoxy resins, acrylic resins, phenol resins, melamine resins, urea resins, urethane resins, vinylether resins, and the like. Other polymers include polyamides, polymethylmethacrylate, and polyolefins.

In an alternative embodiment, the anti-odor agent may be contained in a finish that is then applied to the fabric. The finish may include binders, leveling agents, adherents, thickeners, and the like. For instance, in one embodiment, a binder, such as a polyurethane or an acrylic-type resin may be combined with the anti-odor agent and applied to the fabric as a liquid. Once applied, the fabric may be dried.

The present disclosure may be better understood with reference to the following examples.

EXAMPLES

The following fabrics were produced and tested for various properties.

A fabric was constructed in accordance with the present disclosure. The first yarns contained FR cellulose or viscose combined with meta-aramid fibers, nylon fibers, and para-aramid fibers. The second yarns were spun yarns made from meta-aramid fibers. The fabric had a basis weight of 3.6 oz/sqyd.

The above fabric was combined with three different thermal barrier layers made from a different type of batting. The fabric was attached to the batting layer using a quilted stitch pattern. The resulting composite fabric was then tested for various properties. Below are the results that were obtained:

Sample No. 1

Fiber Blend:
- 65% Meta-Aramid
- 20% FR Viscose
- 11% Nylon
- 4% Para-Aramid

Batting:
- 50% Meta-Aramid/50% Para-Aramid
- Needle punch Batting made with pure fibers Weight:
- 7.6 oz/sqyd Weave:
- Fancy Twill Thickness: 0.08 Inch Color:
- Tan/Black

| | Initial | After 5 Launderings |
|---|---|---|
| Flame Resistance ASTM D 6413 | | |
| Char Length in Inch (Warp × Filling) | 0.6 × 0.5 | 0.7 × 0.6 |
| After Flame in Second (Warp × Filling) | 0 × 0 | 0 × 0 |
| Melt or Drip | 0 | 0 |
| Heat/Thermal Resistance NFPA 1971 | | |
| % of Shrinkage - 5 mn at 500° F. (Warp × Filling) | 1.5 × 0.0 | 1.5 × 0.0 |
| Melt or Drip | 0 | 0 |
| Tear Resistance ASTM D 5587 | | |
| Tear Strength in lbf (Warp × Filling) | 34 × 53 | 36 × 54 |
| Cleaning Shrinkage Resistance (5 Launderings) AATCC 135 | | |
| % of Shrinkage (Warp × Filling) | N/A | 3.5 × 0.0 |

Sample No. 2

Fiber Blend:
- 65% Meta-Aramid
- 20% FR Viscose
- 11% Nylon
- 4% Para-Aramid

Batting:
- 1 Layer of 2.3 oz/Yd$^2$ Aramid
- Spunlace

Weight:
- 5.9 oz/sqyd

Weave:
- Fancy Twill

Thickness:
- 0.04 Inch

Color:
- Tan/Black

| | Initial | After 5 Launderings |
|---|---|---|
| Flame Resistance ASTM D 6413 | | |
| Char Length in Inch (Warp × Filling) | 1.9 × 1.8 | 1.8 × 1.6 |
| After Flame in Second (Warp × Filling) | 0 × 0 | 0 × 0 |
| Melt or Drip | 0 | 0 |
| Heat/Thermal Resistance NFPA 1971 | | |
| % of Shrinkage - 5 mn at 500° F. (Warp × Filling) | 3.0 × 1.5 | 4.0 × 1.0 |
| Melt or Drip | 0 | 0 |
| Tear Resistance ASTM D 5587 | | |
| Tear Strength in lbf (Warp × Filling) | 48 × 45 | 42 × 41 |
| Cleaning Shrinkage Resistance (5 Launderings) AATCC 135 | | |
| % of Shrinkage (Warp × Filling) | N/A | 1.0 × 0.0 |

Sample No. 3
Fiber Blend:
65% Meta-Aramid
20% FR Viscose
11% Nylon
4% Para-Aramid
Batting:
1 Layer of 2.3 oz/Yd$^2$ Aramid Spunlace
1 Layer of 1.5 oz/Yd$^2$ Aramid Spunlace
Weight:
7.4 oz/sqyd
Weave:
Fancy Twill
Thickness:
0.05 Inch
Color:
Tan/Black

| | Initial | After 5 Launderings |
|---|---|---|
| Flame Resistance ASTM D 6413 | | |
| Char Length in Inch (Warp × Filling) | 0.8 × 0.7 | 1.1 × 0.9 |
| After Flame in Second (Warp × Filling) | 0 × 0 | 0 × 0 |
| Melt or Drip | 0 | 0 |
| Heat/Thermal Resistance NFPA 1971 | | |
| % of Shrinkage - 5 mn at 500° F. (Warp × Filling) | 3.5 × 1.5 | 1.0 × 0.0 |
| Melt or Drip | 0 | 0 |
| Tear Resistance ASTM D 5587 | | |
| Tear Strength in lbf (Warp × Filling) | 61 × 70 | 55 × 58 |
| Cleaning Shrinkage Resistance (5 Launderings) AATCC 135 | | |
| % of Shrinkage (Warp × Filling) | N/A | 3.0 × 0.5 |

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A fire resistant garment comprising:

an outer shell shaped to cover a portion of a wearer's body;

an inner lining located inside of said outer shell and positioned to contact a wearer, the inner lining comprising a fabric having first yarns in a first direction and second yarns in a second direction, the first yarns containing FR cellulose fibers in an amount of at least 20% by weight, the second yarns containing inherently flame resistant fibers, the first yarns being woven with the second yarns such that the first yarns form a pattern of shapes, the shapes containing a greater concentration of FR cellulose fibers than present in the remainder of the fabric.

2. A fire resistant garment as defined in claim 1, wherein each shape contains FR cellulose fibers in an amount of at least about 40% by weight.

3. A fire resistant garment as defined in claim 1, wherein the pattern of shapes comprises a pattern of discrete shapes.

4. A fire resistant garment as defined in claim 1, wherein the fabric has a dobby weave.

5. A fire resistant garment as defined in claim 1, wherein the first yarns comprise the warp yarns and the second yarns comprise the fill yarns or alternatively the first yarns comprise the fill yarns and the second yarns comprise the warp yarns.

6. A fire resistant garment as defined in claim 1, wherein the first yarns contain the FR cellulose fibers combined with inherently flame resistant fibers.

7. A fire resistant garment as defined in claim 6, wherein the first yarns further contain non-aromatic polyamide fibers.

8. A fire resistant garment as defined in claim 1, wherein the first yarns comprise flame resistant cellulose fibers in an amount from about 20% to about 50% by weight, meta-aramid fibers in an amount from about 30% to about 60% by weight, non-aromatic polyamide fibers in an amount from about 12% to about 25% by weight, and optionally para-aramid fibers in an amount up to about 15% by weight of the fabric.

9. A fire resistant garment as defined in claim 8, wherein the fabric contains para-aramid fibers in an amount from about 3% to about 15% by weight of the fabric.

10. A fire resistant garment as defined in claim 8, wherein the first yarns contained within the woven fabric are made from an intimate blend of the meta-aramid fibers, the flame resistant cellulose fibers, the non-aromatic polyamide fibers, and optionally the para-aramid fibers.

11. A fire resistant garment as defined in claim 1, wherein the FR cellulose fibers comprise cotton or rayon fibers pretreated with a fire resistant composition.

12. A fire resistant garment as defined in claim 1, wherein the woven fabric contains from about 40% to about 50% by weight meta-aramid fibers, from about 15% to about 20% by weight non-aromatic polyamide fibers, from about 30% to about 35% by weight FR cellulose fibers, and from about 3% to about 8% by weight para-aramid fibers.

13. A fire resistant garment as defined in claim 1, wherein the second yarns comprise at least about 70% by weight inherently flame resistant fibers.

14. A fire resistant garment as defined in claim 1, wherein the second yarns comprise spun yarns.

15. A fire resistant garment as defined in claim 1, wherein the second yarns comprise filament yarns and wherein the inherently flame resistant fibers contained in the second yarns comprise filaments.

16. A fire resistant garment as defined in claim 1, wherein the second yarns contain greater than 50% meta-aramid fibers and comprise spun yarns or filament yarns.

17. A fire resistant garment as defined in claim 1, wherein the first yarns comprise ring spun yarns.

18. A fire resistant garment as defined in claim 1, wherein the shapes form channels for moisture.

19. A fire resistant garment as defined in claim 1, wherein the FR cellulose fibers comprise fibers obtained from beech trees.

20. A fire resistant fabric comprising:

a woven fabric having first yarns in a first direction and second yarns in a second direction, the first yarns containing meta-aramid fibers in an amount from about 30% to about 60% by weight, FR cellulose fibers in an amount from about 20% to about 50% by weight, non-aromatic polyamide fibers in an amount from about 12% to about 25% by weight, and optionally para-aramid fibers in an amount up to 15% by weight, the second yarns containing inherently flame resistant fibers, and wherein the first yarns are in the warp direction and the second yarns are in the fill direction or the first yarns are in the fill direction and the second yarns are in the warp direction, and wherein the first yarns are woven with the second yarns to form a pattern of shapes, and wherein the shades contain a greater concentration of FR cellulose fibers than present in the remainder of the fabric.

* * * * *